US005266060A

United States Patent [19]

Onoue

[11] Patent Number: 5,266,060

[45] Date of Patent: Nov. 30, 1993

[54] STEERING DEVICE FOR MARINE PROPULSION DEVICE

[75] Inventor: Akihiro Onoue, Hamamatsu, Japan

[73] Assignee: Sanshin Kogyo Kabushiki Kaisha, Hamamatsu, Japan

[21] Appl. No.: 835,283

[22] Filed: Feb. 13, 1992

[30] Foreign Application Priority Data

Feb. 14, 1991 [JP] Japan ..... 3-040711

[51] Int. Cl.[5] ..... B63H 25/22

[52] U.S. Cl. ..... 440/61; 114/150; 180/132

[58] Field of Search ..... 114/114 R, 114 E, 150; 440/61, 62; 180/132, 136, 137; 91/59, 509, 510; 92/51, 52, 134, 109

[56] References Cited

U.S. PATENT DOCUMENTS

| | | | |
|---|---|---|---|
| 3,774,568 | 11/1973 | Borst et al. | 114/144 R |
| 4,054,102 | 10/1977 | Borst et al. | 114/144 R |
| 4,744,322 | 5/1988 | Nakase | 114/144 E |
| 4,919,629 | 4/1990 | Isogawa et al. | 440/62 |
| 5,031,562 | 7/1991 | Nakase et al. | 114/150 |
| 5,061,213 | 10/1991 | Burroughs | 440/63 |
| 5,118,051 | 2/1993 | Huber | 114/150 |

FOREIGN PATENT DOCUMENTS

| | | |
|---|---|---|
| 60-134100 | 9/1985 | Japan . |
| 61-1599 | 1/1986 | Japan . |
| 2-60096 | 5/1990 | Japan . |

*Primary Examiner*—Jesûs D. Sotelo
*Attorney, Agent, or Firm*—Ernest A. Beutler

[57] ABSTRACT

The present invention provides an improved apparatus for controlling the steering of a watercraft or the like. Specifically, the steering device of the invention includes a push-pull cable steering arrangement which has a portion located along the rear of the watercraft. Such rearward portion is disposed for reciprocal movement within a cylindrical cable guide. The steering device also includes a hydraulic power assist arrangement which includes a hydraulic cylinder having a moveable piston and associated piston rod contained therein. Operator initiated movement of the push-pull cable arrangement is operable to actuate the hydraulic power assist arrangement, thus aiding in steering maneuvers. In order to provide an exceptionally compact arrangement, the cylindrical cable guide of the push-pull cable steering arrangement is disposed inside of the hydraulic cylinder of the hydraulic power assist arrangement. Furthermore, a portion of the push-pull cable arrangement is contained within a hollow inner region provided within the piston rod. According to such construction, the space required for accommodating the stroke of the push-pull cable arrangement is shared with the space required for accommodating the stoke of the piston and associated piston rod during steering operations.

18 Claims, 4 Drawing Sheets

II
II
52
99
49
47
64
48
35
62
30
26
54
58
27
56
94
28
34
48
60
90
96
92
36
80
78
74
76
40 B
40 A
40
72
64
72
52
47
49
70

52
a
b
47
64
58
56
60
48
62
96
94
90
92
80
36
78
74
76
40
40 A
40 B

STEERING DEVICE FOR MARINE PROPULSION DEVICE

BACKGROUND OF THE INVENTION

This invention relates to a marine steering device and more particularly to an improved apparatus for controlling the steering of a watercraft or the like.

In many marine applications, the watercraft is steered by an operator at a remote location. In order to effect this steering, it has been known to affix a steering arm to the steering device of the watercraft (e.g., a rudder or an outboard drive). The steering arm, in turn, has been connected to the watercraft steering system. The watercraft steering system has often comprised flexible, push-pull cables which extend from an operator controlled steering mechanism (e.g., a steering wheel) to a steering rod which interconnects the cable to the steering arm of the watercraft steering device.

With a purely manual steering system, the driver creates the forces needed to effect turning of the watercraft steering device. Oftentimes manual steering can require a great deal of physical effort on the part of the operator, which may result in operator fatigue. Thus, hydraulic power-assist steering arrangements have been developed for many watercraft today to make steering easier for the driver. This is especially true with watercraft employing large drives or rudder arrangements. The power-assist steering system is designed to reduce the effort needed to turn the steering device. It reduces driver fatigue and increases safety during driving.

In one form of a power-assisted steering device, a hydraulic cylinder piston assembly is employed in combination with a push-pull cable system for aiding an operator in the movement of the watercraft steering device. Normally, steering operations with such a hydraulic device are aided by a hydraulic motor piston assembly that is mounted at or near the transom of the watercraft and which has a piston rod which extends from the cylinder. An outer end of the piston rod is operatively connected to the watercraft steering device for steering it. Pressurized hydraulic fluid is selectively supplied to a specific chamber of the cylinder in response to operator initiated commands, via the push-pull cable system, in order to aid in the movement of the piston contained therein and, thus, to consequently aid in the movement of the outwardly projecting piston rod attached thereto. Accordingly, assistance is rendered to an operator in carrying out steering maneuvers.

While affording the desired aid to an operator in the steering operations of a watercraft, such an arrangement nevertheless presents certain problems. Particularly, since a significant amount of space is required to house and to allow movement for the full stroke of both the steering cable system as well as the piston rod of the hydraulic assist arrangement, the overall combination tends to be quite bulky in size. Thus, there is a present need for a hydraulically assisted watercraft steering arrangement which is effective in operation, yet compact in size.

Therefore, it is a principal object of the present invention to provide an improved watercraft steering arrangement.

It is a further object of the invention to provide a hydraulically assisted steering arrangement which is compact in size and usable in a wide variety of watercraft with a wide variety of drive arrangements.

SUMMARY OF THE INVENTION

The present invention is adapted to be embodied in a steering device for a propulsion arrangement of a watercraft. The invention comprises a reciprocally moveable steering cable system and a cable system guide member for containing and guiding a portion of the steering cable system. The invention further comprises a hydraulic cylinder which is provided with a piston disposed for reciprocal movement therein. Also provided is a piston rod which is associated with the piston and extends outwardly from the piston and is moveable therewith. The hydraulic cylinder and the cable system guide member are fixed against movement with respect to a transom of the watercraft. The cable system guide member and the hydraulic cylinder are arranged so that one is substantially contained within the other in order that the steering cable system portion, and the piston, and a portion of the associated piston rod may all reciprocally move within the boundaries defined by the outer perimeter of the cable system guide member and hydraulic cylinder combination.

DETAILED DESCRIPTION OF THE PREFERRED EMBODIMENTS

Figure 1:
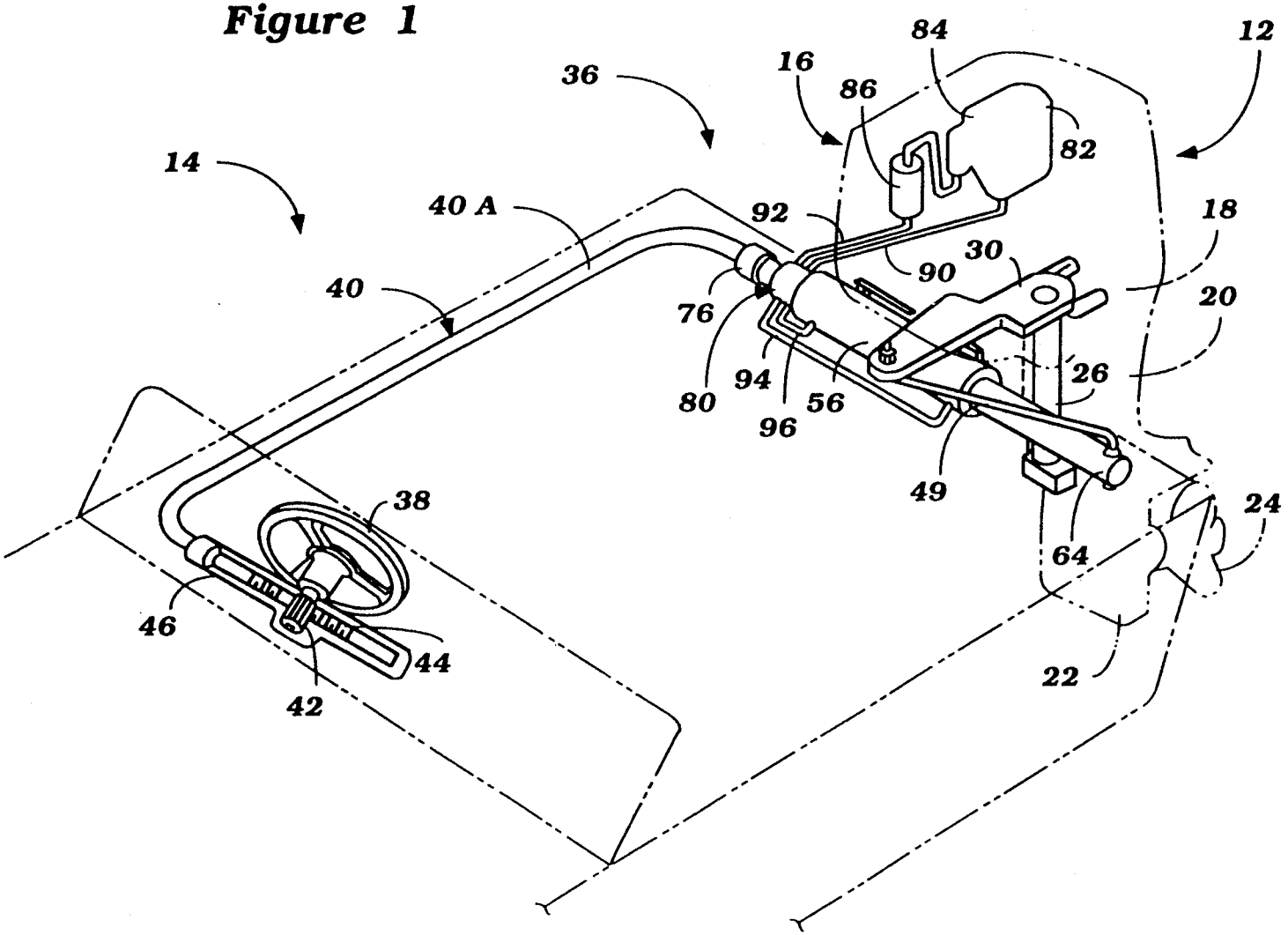
FIG. 1 is an illustration of a watercraft having an outboard motor, shown from a viewpoint looking downward and from one side, which typifies the environment within which a first embodiment of the invention may be practiced.

Referring initially to FIG. 1, an outboard motor, indicated generally by the reference numeral 12, is depicted as attached to a transom of an associated watercraft, indicated generally by the reference numeral 14, which is shown partially and in phantom. While the invention is described in conjunction with an outboard motor, it is to be understood that the invention may be equally as well practiced with the outboard drive portion of an inboard-outboard drive, with a rudder system or other compatible arrangement.

The outboard motor 12 is comprised of a power head 16 that includes an internal combustion engine (not shown), which may be of any known type, and which is enclosed within a protective cowling, shown in phantom and indicated by the reference numeral 18. A driveshaft housing 20 depends from the power head 16 and contains a drive shaft (not shown) that is driven by an output shaft of the power head engine. This drive shaft, in turn, drives a forward, neutral, reverse transmission (not shown) that is contained within a lower unit 22 for driving a propeller 24 in selected forward or reverse directions.

Figure 2:
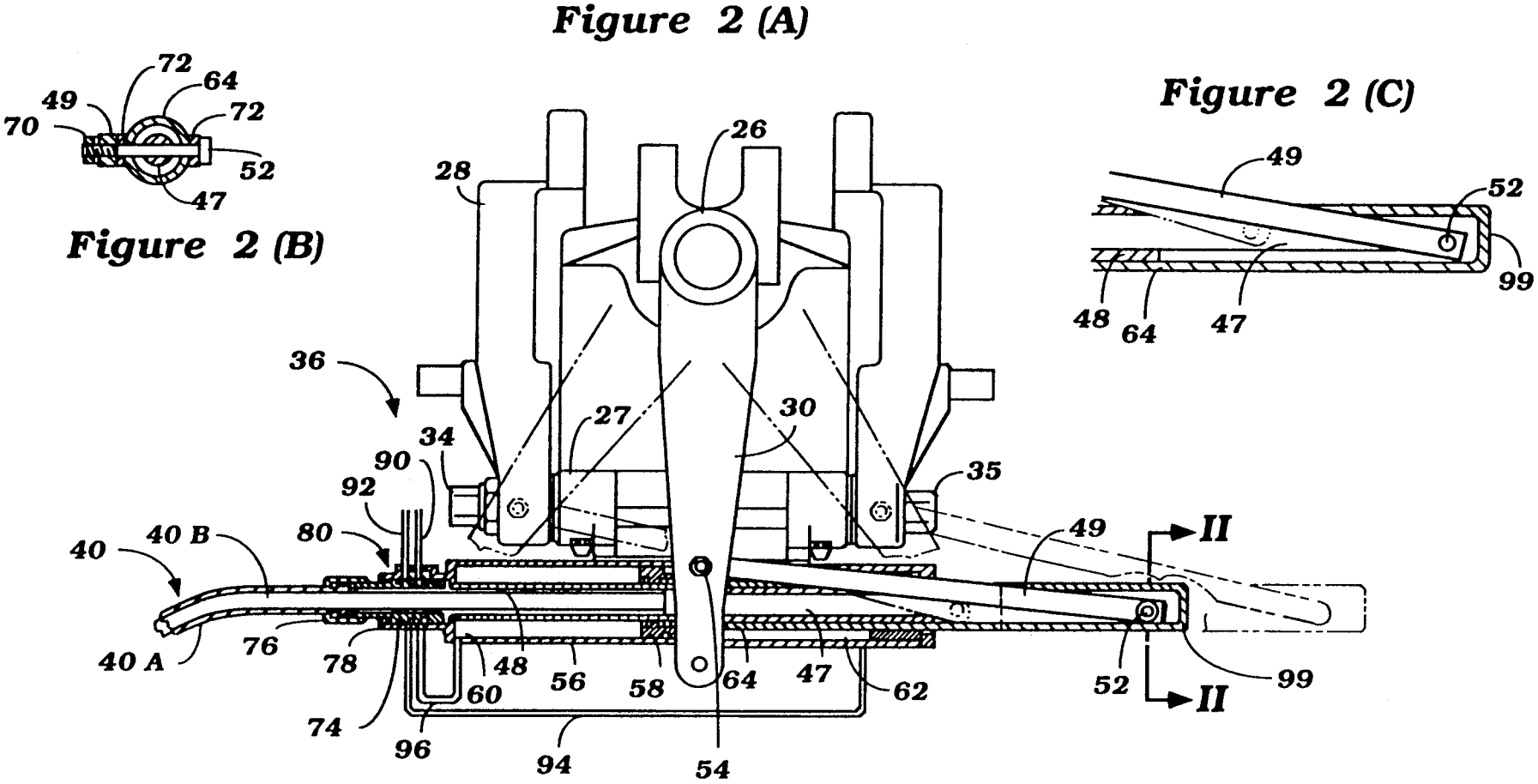
FIG. 2(A) is a top plan view, with portions shown in section, of the first embodiment of the steering device of the present invention as depicted in FIG. 1.
FIG. 2(B) is a cross-sectional view taken along the line II—II of FIG. 2(A).
FIG. 2(C) is an enlarged cross-sectional view of an outer end portion of the steering device as depicted in FIG. 1.

With additional reference to FIG. 2(A), a steering bracket 26 is affixed to the drive shaft housing 20 in a known manner and is journaled within a swivel bracket 27 to enable steering movement about a generally vertically extending steering axis. A steering arm 30 is affixed to the upper end of the steering bracket 26 for effecting operator controlled steering of the drive shaft housing 20 about this steering axis and, consequently, steering of the outboard motor 12 and associated watercraft 14.

The swivel bracket 27 is pivotally connected to a clamping bracket 28 by means including a generally horizontally extending pivot pin (not shown) which is hollow through its longitudinal center and which is provided with caps 34 and 35 at both ends to prevent corrosion. This pivotal connection permits trim adjustment of the outboard motor 12 and also permits the outboard motor 12 to be tilted up to an out of the water position, as is well known in this art. The clamping bracket 28 is, in turn, adapted to be affixed to the transom of the watercraft 14 in a known manner.

The construction as thus far described may be considered to be conventional and since the aforedescribed construction does not, alone, form the present invention, but rather an environment in which the invention may be practiced, a more detailed description of the construction is believed to be unnecessary in order to understand the invention.

The construction and operation of the steering device of the invention, indicated generally by the reference numeral 36, will now be described.

In accordance with the invention, an arrangement is provided for facilitating remote steering of the outboard motor 12 by means of a remotely positioned steering wheel 38. A flexible, push/pull-type cable, indicated by the numeral 40, extends from a position adjacent the steering wheel 38 to the steering device 36 of the invention. The steering wheel 38 may impart movement to the cable 40 by any suitable means, and is depicted in FIG. 1 as employing a pinion 42 disposed at a forwardmost end of a forwardly extending shaft of the steering wheel 38 which mechanically engages, via meshing gear teeth, a rack bar 44 disposed within a guide housing 46. Thus, turning of the steering wheel 38 is able to impart reciprocal motion to the rack bar 44 within the guide 46 by way of the pinion 42. The rack bar 44 is attached to the cable 40 at one end so that movement of the rack bar 44 causes a corresponding movement of the cable 40.

As best seen in FIG. 2(A), the cable 40 is a coaxial cable having an outer cable portion 40A and an inner cable portion 40B. Each cable portion, 40A and 40B, is structurally arranged to be operable to perform a unique function according to the invention, as will be described.

The inner cable portion 40B is attached to a steering rod member 47 which is positioned for movement along the rearward region of the watercraft 14. The inner cable portion 40B is operable to impart back and forth motion to the steering rod 47, in response to its own movement. The steering rod 47 is held in place for such movement within a cylindrical guide 48. The cylindrical guide 48 is positioned so that it will remain stationary, relative to the rest of the steering arrangement, during steering operations. As shown in FIGS. 1 and 2(A), the cylindrical guide may be mounted upon the hull of the watercraft forwardly of the swivel bracket 27. Alternatively, the cylindrical guide may be formed through the hollow portion of the pivot pin which pivotally mounts the clamp bracket 28 and the swivel bracket 27, as set forth above.

An elongate linking member 49 is pivotally connected to an outer end of the steering rod 47, remote from the end attached to the inner cable portion 40B, by way of a bolt member 52. The linking member 49 is additionally pivotally connected to a forward region of the steering arm 30 by way of another bolt member 54. As a result of such construction, a pivotal mechanical interconnection is established between the steering rod 47 and the steering arm 30 wherein reciprocal movement of the steering rod 47 will be translated into rotary motion of the steering arm 30.

The cylindrical guide 48 forms a portion of a dual-cylinder arrangement of the invention which comprises two cylinders having different diameters. In this arrangement, the cylinders are disposed concentrically with respect to one another. The cylindrical guide 48 is the inner cylinder in this dual-cylinder arrangement, and a hydraulic cylinder 56, formed outwardly about the guide 48, is the outer cylinder. The entire dual-cylinder arrangement is disposed so that it will remain stationary, with respect to the rest of the steering arrangement, during steering operations.

The outer cylinder 56 contains a piston 58 which is disposed for reciprocal movement therein. Specifically, the piston 58 is positioned in an interstice defined by an inner wall of the hydraulic cylinder 56 and an outer wall of the cylindrical guide 48. Fluid chambers 60 and 62, which are formed within the interstice of the hydraulic cylinder 56, are located to either side of the piston member 58. A piston rod 64 is attached at one end of the piston 58 for movement therewith, and extends outwardly of the hydraulic cylinder 56 in the same direction as the steering rod 47. The piston rod 64 is hollow through its longitudinal length and envelops much of the steering rod 47.

The steering rod 47 and the piston rod 64 are secured together along their outer end regions via the threaded bolt member 52 which passes through mating orifices formed through each member, so that these members can move together in unison. It is at this connecting point that the pivotal connection between the steering rod 47 and the linking member 49, set forth above, is formed. This is accomplished by additionally passing the bolt member 52 through a collar formed at a corresponding end of the link 49. Such connections can best be seen with reference to FIGS. 2(A), 2(B) and 2(C). With particular reference now to FIG. 2(B), a threaded nut 70 is receivable upon one end of the bolt 52 to insure a secure engagement of these elements. Seals 72 are positioned at the interface of the head of the bolt 52 and an adjacent outer portion of the piston rod 64 and also at the interface of the collared portion of the link 49 and an adjacent outer portion of the piston rod 64, in order to insure an effective seal about the orifices formed through the piston rod 64.

The outer cable portion 40(A) extends from a location whereat it is affixed to the guide housing 46 along the front of the watercraft 14 in a direction rearwardly towards the steering device 36. As best seen in FIG. 2(A), the end of the outer cable portion 40(A), along the region of the steering device 36, is held in contact with a spool device 74 by way of a screw cap 76. The spool device 74 is housed within a spool housing unit 78 and forms a part of a hydraulic fluid direction control arrangement, generally indicated by the reference numeral 80.

The spool member 74 is reciprocally moveable back and forth within the spool housing 78 in response to movement of the outer cable portion 40(A) with which it is held in contact. The spool member 74 is provided with conduits formed therethrough. These conduits communicate hydraulic circuit lines (90, 92, 94 and 96) with one another in a selective fashion, depending upon the hydraulic fluid flow direction required for effecting steering assist.

Generally, the hydraulic fluid system of the steering arrangement of the invention includes a hydraulic circuitry which allows for the selective routing of pressurized fluid to one of the fluid chambers (60 or 62) within the hydraulic cylinder 56 in order to assist an operator in effecting steering maneuvers of the watercraft 14 by moving the piston 58 and the associated piston rod 64 which are ultimately connected to the steering arm 30, as set forth above.

The fluid is pressurized by way of a pump unit 82 which is contained within the cowling 18 of the outboard motor 12. A cooler 84 and a filter 86 are provided within the circuit to help maintain the fluid in a suitable physical state for its intended use. The various fluid lines (identified by the references numerals 90, 92, 94 and 96) allow the hydraulic fluid to flow within the circuit, as necessary, in order to effect the desired steering results.

Having set forth above the construction and structural relationships of the components of the steering device of the invention; the operation of the device will now be described with particular reference to FIGS. 3(A), 3(B) and 3(C).

Figure 3:
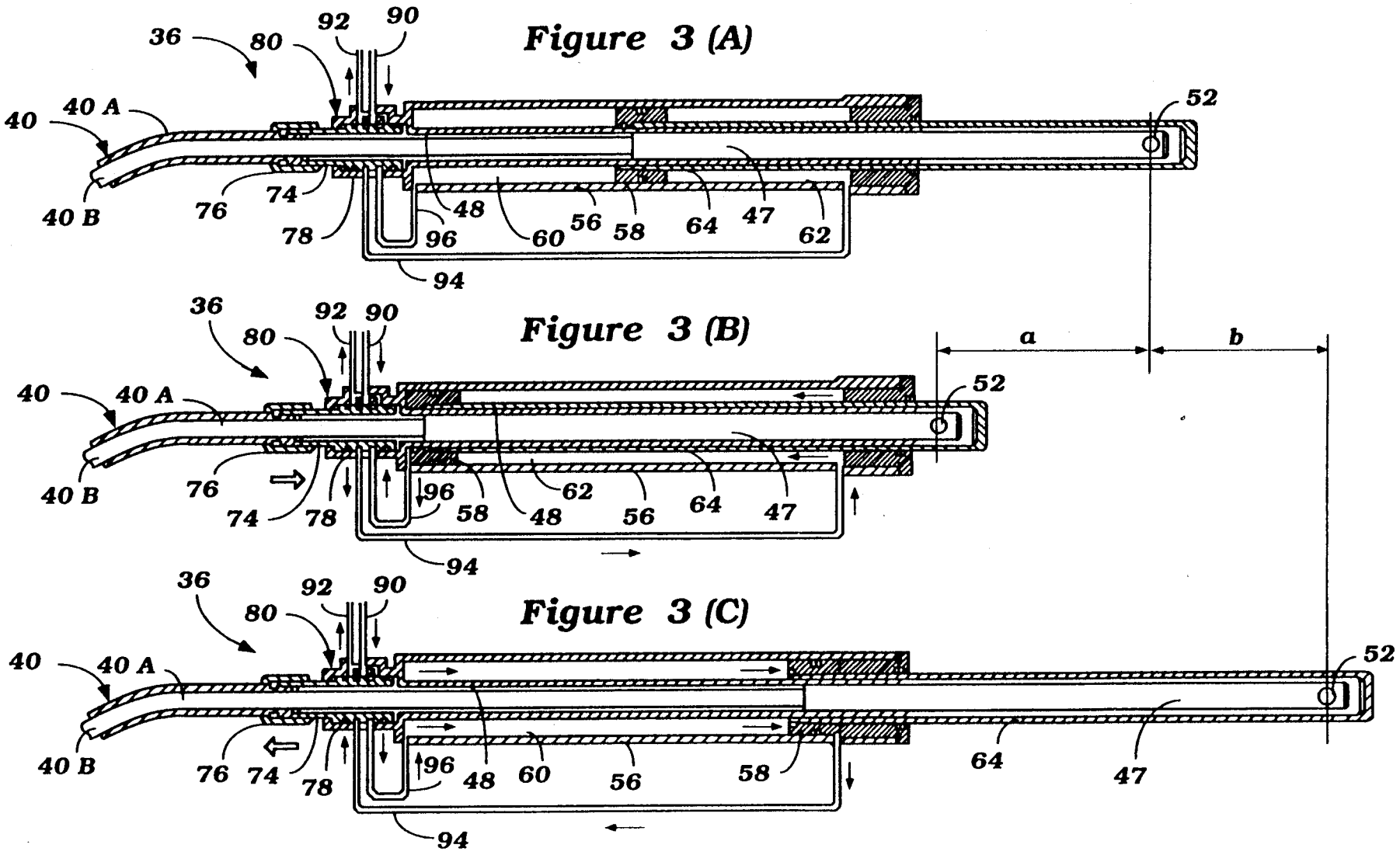
FIGS. 3(A), 3(B) and 3(C) are sectional views taken through portions of the steering device as depicted in FIGS. 1 and 2(A)–(B), and which depict the operation of the first embodiment of the present invention.

FIG. 3(A) is a sectional view, taken through portions of the steering device as depicted in FIGS. 1 and 2(A)-(B), depicting the operation of the first embodiment of the present invention when the steering arrangement is in its neutral position. That is to say, FIG. 3(A) shows the steering device when there is no force tending to steer the watercraft 14 towards the left or toward the right.

When the steering wheel 38 is located in its neutral position the spool member 74 is similarly situated in a neutral location, as far as steering operations are concerned. When in this neutral location, the conduits of the spool member 74 are arranged so that the pressure within the two fluid chambers, 60 and 62, are balanced and, thus, no biasing force is applied upon either side of the piston member 58 within the hydraulic cylinder 56. Accordingly, the piston 58 and associated piston rod 64 are not moved and no steering assistance is imparted to the steering arm 30.

FIG. 3(B) shows the steering arrangement during an operation wherein the watercraft is steered in a leftward direction. When the steering wheel 38 is steered towards the left (i.e., counterclockwise), the inner cable 40(B) and steering rod 47 are pulled and thereby caused to move in a direction towards the front of the watercraft 14. Subsequent to, and as a result of, this frontward movement, the outer cable portion 40(A) is caused to move in an opposite direction (as shown by the white arrow). Such movement of the outer cable portion 40(A) moves the spool member 74 in a direction corresponding thereto. The spool member 74 is thus positioned within the spool housing 78 so as to allow pressurized fluid to pass from the pressure line 90 into the communicating line 94, and ultimately into the fluid chamber 62 within the hydraulic cylinder 56. Accordingly, the chamber 62 is subjected to an increased pressure therein, which pressure is imposed upon the adjacent side of the piston member 58. This pressure moves the piston in a direction tending to retract the piston rod 64 into the hydraulic cylinder assembly 56. Further, as such movement of the piston member 58 occurs, the current positioning of the spool member 74 allows fluid to exit the fluid chamber 60 of the hydraulic cylinder 56 through the communicating line 96 and to return to the pump unit 82 through the return line 92. The fluid movement and hydraulic pressure forces are indicated by the blackened arrows of FIG. 3(B). The retracting movement of the piston rod 64 supplies steering assistance to an operator in moving the steering arm 30, via its pivotal connection to the interconnecting linking member 49. The maximum leftward displacement, as measured from the neutral position of the steering device as shown in FIG. 3(A), available during the turning operation illustrated in FIG. 3(B) is represented by the reference letter "a".

FIG. 3(C) shows the steering arrangement during an operation wherein the watercraft is steered in a rightward direction. When the steering wheel 38 is steered towards the right (i.e., clockwise), the inner cable 40(B) and steering rod 47 are pushed and thereby caused to move in a direction towards the rear of the watercraft 14. Subsequent to, and as a result of, this rearward movement, the outer cable portion 40(A) is caused to move in an opposite direction (as shown by the white arrow). Such movement of the outer cable portion 40(A) moves the spool member 74 in a direction corresponding thereto. The spool member 74 is thus positioned within the spool housing 78 so as to allow pressurized fluid to pass from the pressure line 90 into the communicating line 96, and ultimately into the fluid chamber 60 within the hydraulic cylinder 56. Accordingly, the chamber 60 is subjected to an increased pressure therein, which pressure is imposed upon the adjacent side of the piston member 58. This pressure moves the piston in a direction tending to push the piston rod 64 out of the hydraulic cylinder assembly 56. Further, as such movement of the piston member 58 occurs, the current positioning of the spool member 74 allows fluid to exit the fluid chamber 62 of the hydraulic cylinder 56 through the communicating line 94 and to return to the pump unit 82 through the return line 92. The fluid movement and hydraulic pressure forces are indicated by the blackened arrows of FIG. 3(C). This outward movement of the piston rod 64 supplies steering assistance to an operator in moving the steering arm 30, via its pivotal connection to the interconnecting linking member 49. The maximum rightward displacement, as measured from the neutral position of the steering device as shown in FIG. 3(A), available during the turning operation illustrated in FIG. 3(C) is represented by the reference letter "b".

There are a number of advantages to be gained over the prior power-assist steering arrangements in light of the structure taught by the present invention. For example, the space required for the steering stroke of the inner cable 40B and steering rod 47 is common to the space required for the steering stroke of the piston 58 and associated piston rod 64. Thus, the arrangement is compact. Also, since the tilt pin of the tilt/trim adjusting arrangement is not utilized for receiving the steering rod 47 or cable 40, each end of the tilt pin can be covered and closed by a corrosion preventing sealing cap (34 and 35). Thus, no lubricating arrangement is required in order to prevent the corrosion of the tilt pin. Additionally, the outermost end 99 of the piston rod 64 (remote from the piston member 58) is fully closed, as shown in the Figures depicting the first embodiment; and also, the orifices which pass the pivot bolt 52 through the piston rod 64 are effectively sealed by the seal members 72. Therefore, the steering rod 47 and inner cable 40B are shielded against potentially damaging externalities and, thus, protected against corrosion. Further, the spool 74 and spool housing 78 are accommodated in very close proximity to the hydraulic cylinder arrangement, and may be formed integrally therewith, in order to further aid in providing a very compact overall power-assist arrangement. Also, the communicating pipes 94 and 96 remain stationary during operation of the steering device 36 and, thus, do not interfere with other elements in their vicinity.

Figure 4:
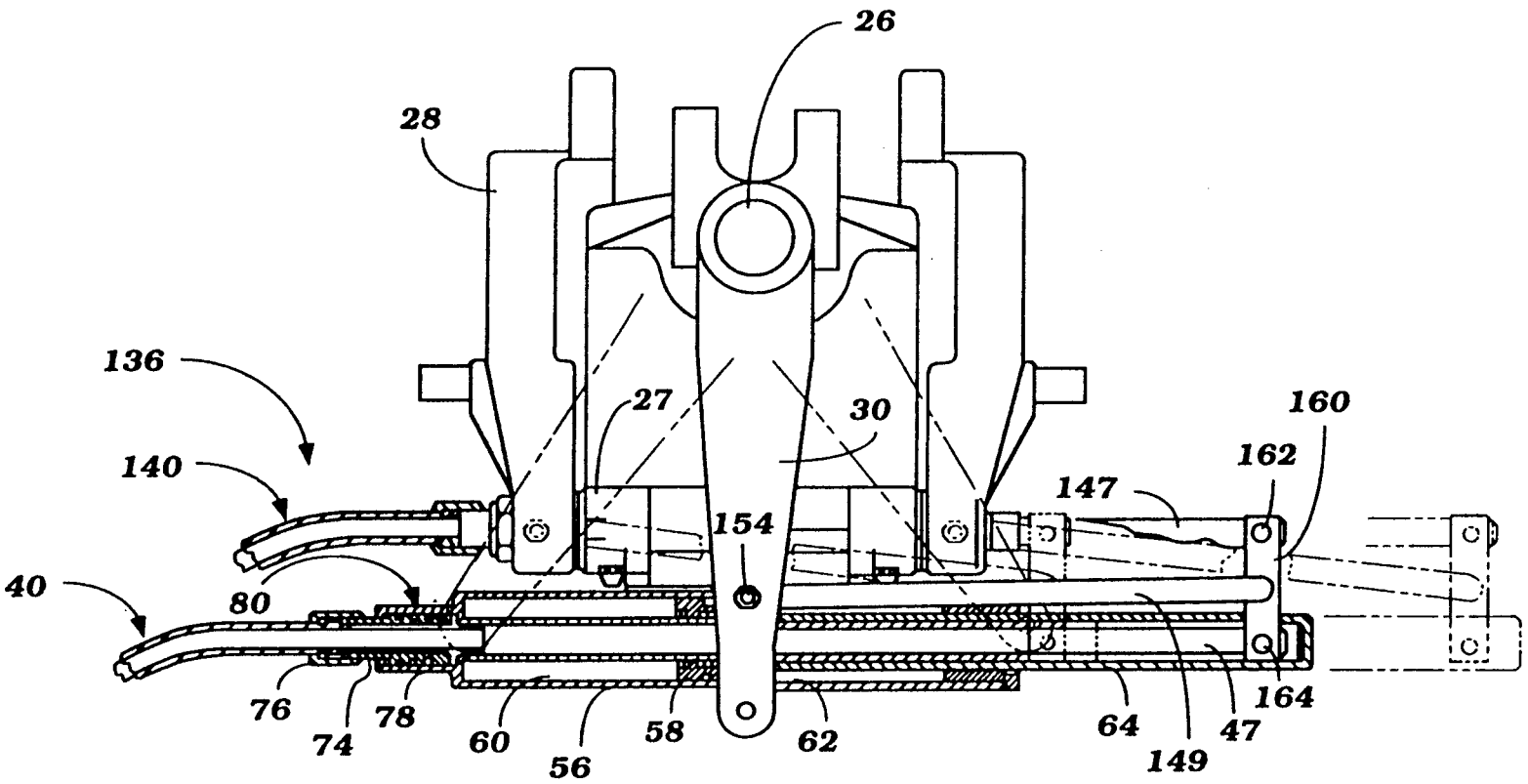
FIG. 4 is a partial top plan view, with portions shown in section, of a second embodiment of the steering device of the present invention.

FIG. 4 is a partial top plan view, with portions shown in section, of a second embodiment of the steering device of the present invention, which is next described. It is to be noted that many of the elements utilized in the second embodiment are identical to those employed in the first embodiment, as described above. Thus, where like elements are shown in the Figures, they are described with like reference numerals. Furthermore, only those portions of the second embodiment which are necessary in order to understand its structure and operation are shown and discussed. Accordingly, it is to be understood that the components of, and associated environment for practicing, the second embodiment may be assumed to be the same as set forth above with regard to the first embodiment where not explicitly described below.

In the second embodiment, a two-cable system 136 is employed for turning the steering arm 30. Specifically, a first cable arrangement 40 is provided which is similar to that of the first embodiment and, additionally, a second cable arrangement 140 is provided nearby, in a generally parallel fashion with respect to the first cable arrangement 40. As depicted in FIG. 4, the additional cable arrangement 140 extends through the hollow pivot pin of the tilt/trim arrangement in order to provide the additional cable 140 with an immovable support shaft within which it may reciprocate during steering operations.

The second cable arrangement has a steering rod 147 positioned at its end, which rod is analogous to the steering rod 47 of the first cable arrangement. As shown in the Figure, a bracket member 160 is attached along the end of the steering rod 147 by a connecting pin 162. The bracket member 160 spans the gap between the steering rods 147 and 47 and is attached along the end of the steering rod 47/piston rod 64 combination by way of another connecting pin 164. The bracket member 160 allows the steering rod 147 and steering rod 47/piston rod 64 combination to act in concert during steering operations. A linking member 149 is pivotally connected midway along the longitudinal length of the bracket member. The linking member 149 extends to a forward region of the steering arm 30, at which point it is pivotally connected thereto via a pivot bolt 154. The link 149 is thus able to transmit reciprocating movement of the steering rod 147 and steering rod 47/piston rod 64 combination into rotary movement of the steering arm 30, steering bracket 26, and outboard drive 12 for effecting steering.

The hydraulic assist structure and operation as contemplated by the second embodiment are the same as taught according to the first embodiment of the invention. The positioning of various elements of the second embodiment during leftward and rightward steering motions are shown in phantom in FIG. 4.

It should be appreciated that the additional control cable 140 helps to ensure ease of steering operations and maintains good reliability of the system by spreading the forces involved in effecting steering maneuvers over a plurality of components. Since the second cable arrangement 140 is placed close to the hydraulic assembly, and within a component which already forms a portion of the outboard drive arrangement (namely, the tilt pin), a compact arrangement is maintained. The tilt pin can be kept relatively small in diameter since it need not house an extraordinarily large steering rod. This is because the steering rod 147 can be kept small due to the fact that its steering functions are shared with the associated steering rod 47 within the hydraulic cylinder 56.

It is to be understood that the foregoing described embodiments are only those which are the preferred embodiments of the invention, and that various changes and modifications may be made without departing from the spirit and scope of the invention, as defined by the appended claims.

It is claimed:

1. A steering device for a propulsion arrangement of a watercraft, comprising: a watercraft having a reciprocally moveable steering cable system; a cable system guide member for containing and guiding a portion of said steering cable system; a hydraulic cylinder; a piston disposed for reciprocal movement within said hydraulic cylinder; a piston rod associated with said piston and extending outwardly from said piston and moveable therewith; wherein said hydraulic cylinder and said cable system guide member are fixed against movement with respect to a transom of said watercraft; wherein said cable system guide member and said hydraulic cylinder are arranged so that one is substantially contained within the other in order that said steering cable system portion, and said piston, and a portion of said associated piston rod may all reciprocally move within the boundaries defined by the outer perimeter of the cable system guide member and the hydraulic cylinder; and further comprising a steered unit and a steering arm which is attached to, and extends outwardly of, said steered unit, so that rotary movement of said steering arm turns said steered unit; and an interlinking member, said interlinking member mechanically communicating said steering arm with said steering device; wherein said hydraulic cylinder, said piston, and said piston rod comprise, in part, a steering power assist arrangement for aiding an operator in maneuvering said watercraft; wherein said steering cable system includes a flexible cable and a steering rod attached at an end of said flexible cable; wherein said steering rod comprises at least a part of said portion of said steering cable system which is contained within said cable system guide member; wherein said cable system guide member is coaxially disposed within said hydraulic cylinder; wherein said piston rod is hollow along its longitudinal central axis; wherein said piston rod substantially envelops said steering rod; and further comprising a fastener which secures said steering rod and said piston rod together, thereby fixing the position of said steering rod within said piston rod so that these two members can move in concert; wherein back and forth movement of said cable actuates said steering power assist arrangement; wherein the outermost end of said piston rod, remote from aid piston, is fully closed; and further comprising seals positioned against said piston rod at the location whereat said piston rod and said steering rod are fastened together, said seals being effective to protect the inside of said piston rod from matter located externally thereof.

2. The steering device of claim 1 further comprising a tilt pin and a tilt/trim arrangement for pivoting said propulsion arrangement about a generally horizontally extending axis defined by said tilt pin; wherein said tilt pin has a substantially hollow inner region; and wherein said cable system guide member is located externally of said tilt pin.

3. The steering device of claim 2 further comprising a hydraulic fluid pump and a hydraulic fluid direction control arrangement; a hydraulic fluid delivery line leading away from said hydraulic fluid pump to said hydraulic fluid direction control arrangement; and a hydraulic fluid return line leading from said hydraulic fluid direction control arrangement to said hydraulic fluid pump.

4. The steering device of claim 3 further comprising a first hydraulic fluid chamber located to one side of said piston within said hydraulic cylinder; a second hydraulic fluid chamber located to the other side of said piston within said hydraulic cylinder; a first hydraulic fluid communication line leading from said hydraulic fluid direction control arrangement to said first chamber; and a second hydraulic fluid communication line leading from said hydraulic fluid direction control arrangement to said second chamber.

5. The steering device of claim 4 wherein said hydraulic fluid direction control arrangement includes a spool and a spool housing, for containing said spool, and a plurality of conduits through said spool; wherein said spool is moveable back and forth within said spool housing, in response to movement of said steering cable system, so that said plurality of conduits selectively align with said hydraulic fluid delivery line, said hydraulic fluid return line, said first hydraulic fluid communication line, and said second hydraulic fluid communication line.

6. The steering device of claim 5 wherein said spool housing is integrally formed with said hydraulic cylinder and is disposed very proximate thereto.

7. The steering device of claim 6 wherein said flexible cable of said steering cable system is a coaxial cable having an inner portion which connects to said steering rod and further having an outer portion which connects to said spool and controls the movement of said spool.

8. The steering device of claim 7 wherein said tilt pin is provided with sealing caps at each end region thereof, said sealing caps preventing corrosive external conditions from damaging said tilt pin.

9. The steering device of claim 2 further comprising a second steering cable system, said second steering cable system disposed near said hydraulic cylinder.

10. The steering device of claim 9 further comprising a second steering cable system guide, wherein said second steering cable system guide is located within said hollow inner region of said tilt pin.

11. The steering device of claim 10 wherein said second steering cable system includes a second steering rod which is disposed for reciprocal movement within said second steering cable system guide; and further comprising a bracket member rigidly interconnecting an outer end of said piston rod to an outer end of said second steering rod, so that these two members can move in concert.

12. The steering device of claim 11 wherein said interlinking member is an elongate link which is pivotally connected at approximately midway along said bracket member and which is additionally pivotally connected to a forwardly located portion of said steering arm in order that reciprocal motion of said bracket member, resulting from motion of said piston rod and said second steering rod, is translated into rotary motion of said steering arm.

13. A steering device for a propulsion arrangement of a watercraft, comprising: a watercraft having a reciprocally moveable steering cable system; a cable system guide member for containing and guiding a portion of said steering cable system; a hydraulic cylinder; a piston disposed for reciprocal movement within said hydraulic cylinder; a piston rod associated with said piston and extending outwardly from said piston and moveable therewith; wherein said hydraulic cylinder and said cable system guide member are fixed against movement with respect to a transom of said watercraft; wherein said cable system guide member and said hydraulic cylinder are arranged so that one is substantially contained within the other in order that said steering cable system portion, and said piston, and a portion of said associated piston rod may all reciprocally move within the boundaries defined by the outer perimeter of the cable system guide member and the hydraulic cylinder; and wherein the outermost end of said piston rod, remote from said piston, is fully closed.

14. The steering device of claim 13 further comprising a second steering cable system, said second steering cable system disposed near said hydraulic cylinder.

15. A steering device for a propulsion arrangement of a watercraft, comprising: a watercraft having a reciprocally moveable steering cable system; a cable system guide member for containing and guiding a portion of said steering cable system; a hydraulic cylinder; a piston disposed for reciprocal movement within said hydraulic cylinder; a piston rod associated with said piston and extending outwardly from said piston and moveable therewith; wherein said hydraulic cylinder and said cable system guide member are fixed against movement with respect to a transom of said watercraft; wherein said cable system guide member and said hydraulic cylinder are arranged so that one is substantially contained within the other in order that said steering cable system portion, and said piston, and a portion of said associated piston rod may all reciprocally move within the boundaries defined by the outer perimeter of the cable system guide member and the hydraulic cylinder; and further comprising a second steering cable system, said second steering cable system disposed near said hydraulic cylinder.

16. The steering device of claim 15 further comprising a tilt pin and tilt/trim arrangement for pivoting said propulsion arrangement about a generally horizontally extending axis defined by said tilt pin; wherein said tilt pin has a substantially hollow inner region; and wherein said cable system guide member is located externally of said tilt pin.

17. The steering device of claim 16 further comprising a second steering system guide, wherein said second steering cable system guide is located within said hollow inner region of said tilt pin.

18. The steering device of claim 17 wherein the outermost end of said piston rod, remote from said piston, is fully closed.

* * * * *